US005092961A

United States Patent [19]

Keller

[11] Patent Number: 5,092,961

[45] Date of Patent: Mar. 3, 1992

[54] APPARATUS FOR CLEANING A POROUS COVER

[75] Inventor: Samuel F. Keller, Beloit, Wis.

[73] Assignee: Beloit Corporation, Beloit, Wis.

[21] Appl. No.: 204,438

[22] Filed: Jun. 9, 1988

[51] Int. Cl.[5] ..... D21F 3/00; D21F 7/00

[52] U.S. Cl. ..... 162/48; 162/274; 162/276; 162/279; 162/199; 134/138; 134/149; 134/153; 134/157

[58] Field of Search ..... 162/48, 274, 276, 279, 162/272, 275, 199; 134/153, 138, 157, 149; 15/256.51; 384/100, 12, 114, 116; 269/20, 71; 55/294

[56] References Cited

U.S. PATENT DOCUMENTS

| | | | |
|---|---|---|---|
| 3,974,026 | 8/1976 | Emson et al. | 162/358 |
| 4,234,175 | 11/1980 | Sato et al. | 269/73 |
| 4,568,423 | 2/1986 | Laapotti | 162/358 |
| 4,748,736 | 6/1988 | Miihkinen | 29/527.2 |

FOREIGN PATENT DOCUMENTS

| | | | |
|---|---|---|---|
| 477799 | 10/1951 | Canada | 162/358 |

*Primary Examiner*—David A. Simmons
*Assistant Examiner*—Thi Dang
*Attorney, Agent, or Firm*—Dirk J. Veneman; Raymond W. Campbell; David J. Archer

[57] ABSTRACT

An apparatus is disclosed for cleaning a porous cover of a press roll of a papermaking machine. The apparatus includes a hydrostatic bearing disposed adjacent to the porous cover, the bearing defining a concave surface for cooperating with porous cover. The bearing defines a fluid conveying passageway having a first and a second end. The first end of the passageway is connected to a source of pressurized fluid and the second end is in fluid communication with the concave surface such that in use of the apparatus, when the porous cover of the press roll rotates, the fluid passes through the passageway and along the concave surface and between the concave surface and the porous cover. The pressurized fluid flow inwardly through the porous cover for flushing contaminants lodged within the porous cover outwardly away from the porous cover thereby inhibiting the buildup of comtaminants on the external surface of the porous cover that would otherwise impair the water absorbing capabilities of the cover.

16 Claims, 1 Drawing Sheet

APPARATUS FOR CLEANING A POROUS COVER

BACKGROUND OF THE INVENTION

1. Field of the Invention

The present invention relates to an apparatus for cleaning a porous cover of a press roll of a papermaking machine. More particularly, this invention relates to the cleaning of a porous, metallic cover which comes into direct contact with the paper web to be pressed.

2. Information Disclosure Statement

In a typical press section of a papermaking machine, a web to be pressed is supported by a press felt during passage of the web through a press nip. Alternatively, the web is sandwiched between cooperating press felts during passage through a press nip.

Although much research has been carried out in an effort to provide a press felt having a smooth surface, such prior proposals have not proven entirely successful.

In view of the high pressure exerted on the web during passage of the web through the press nip, the textured surface of the press felt tends to mark the surface of the pressed web and imparts to the web a surface which is not smooth.

Ideally, a press felt should have the capability of absorbing water pressed from the web during passage through the press nip. Also, such press felt should have a perfectly smooth surface such that a smooth surface is generated on the resultant pressed web emerging from the press nip.

Porous roll covers have been proposed as substitutes for press felts. However, such prior porous roll covers tend to unduly yield under the extremely high pressures applied to the web at the press nip.

U.S. Pat. No. 3,262,840 to Arthur D. Little issued July 26, 1966 teaches a solid core roll having a porous nylon cover applied thereto. However, not only does the nylon cover tend to yield and creep during passage through the press nip, but also there exists the problem of a buildup of contaminants within the porous cover during use of such porous roll covers.

Also, DE3131083 to Berger et al teaches pumping cleaning fluid through a porous cover but from the inside of the roll outwards. However, such arrangement requires a relatively complex roll structure.

The present invention seeks to overcome both of the aforementioned problems by providing a metallic, porous roll cover which is capable of withstanding the high compressive loads applied at the press nip. Additionally, the present invention provides a simple means for cleaning the porous cover continually during use thereof.

Therefore it is a primary object of the present invention to overcome the aforementioned inadequacies of the prior art proposals and to provide an improved apparatus that makes a significant and substantial contribution to the papermaking art.

Another object of the present invention is the provision of an apparatus for cleaning a porous cover in which a hydrostatic bearing is disposed adjacent to the cover for supporting the press roll, the bearing defining a concave surface which cooperates with the porous cover.

Another object of the present invention is the provision of an apparatus for cleaning a porous cover in which the bearing defines a fluid conveying passageway. The passageway has a first and a second end with the first end being connected to a source of pressurized fluid and the second end being in fluid communication with the concave surface. The apparatus is such that in use of the apparatus when the porous cover of the press roll rotates, fluid passes through the passageway and along the concave surface and between the concave surface and the porous cover so that the pressurized fluid flows inwardly through the porous cover for flushing contaminants lodged within the porous cover outwardly away from the porous cover.

Another object of the present invention is the provision of an apparatus for cleaning a porous cover of a press roll in which the buildup of contaminants on the external surface of the porous cover is inhibited thereby increasing the water-absorbing capabilities of the cover.

Another object of the present invention is the provision of an apparatus for cleaning a porous cover of a press roll in which the pressurized fluid is water.

Another object of the present invention is the provision of an apparatus for cleaning a porous cover in which the pressurized fluid is air.

Another object of the present invention is the provision of an apparatus for cleaning a porous cover of a press roll in which the press roll includes a solid roll core and a porous cover which extends circumferentially around and axially relative to the roll core.

Another object of the present invention is the provision of an apparatus for cleaning a porous cover of a press roll in which the roll cover is metallic.

Another object of the present invention is the provision of an apparatus for cleaning a porous cover of a press roll, the metallic roll cover being hot isostatically pressed onto the roll core (hot isostatic pressing is a powder metallury technique of fabrication).

Another object of the present invention is the provision of an apparatus for cleaning a porous cover of a press roll in which the porous cover is fabricated by a powder metallurgy technique in which the metallic powder particles having a size within the range 50–200 microns are isostatically pressed against the press roll.

Another object of the present invention is the provision of an apparatus for cleaning a porous cover of a press roll in which the metallic powder is of the type known as INCONEL 625.

Another object of the present invention is the provision of an apparatus for cleaning a porous cover of a press roll in which the porous cover is flame-sprayed onto the roll core.

Another object of the present invention is the provision of an apparatus for cleaning a porous cover of a press roll in which the porous cover is ceramic.

Another object of the present invention is the provision of an apparatus for cleaning a porous cover of a press roll in which the external surface of the porous cover is machined to define a smooth, cylindrical surface thereon for direct contact with a paper web to be pressed.

Another object of the present invention is the provision of a method for cleaning a porous cover of a press roll in which the press roll is hydrostatically supported on a hydrostatic bearing and pressurized fluid is injected through the external surface of the porous cover for flushing contaminants within the porous cover outwardly away from the porous cover thereby inhibiting the buildup of contaminants on the external surface of the porous cover.

Other objects and advantages of the present invention will be apparent to those skilled in the art by a consideration of the detailed description contained hereinafter taken in conjunction with the annexed drawings which show a preferred embodiment of the present invention.

SUMMARY OF THE INVENTION

The present invention relates to an apparatus and method for cleaning a porous cover of a press roll of a papermaking machine. The apparatus includes a hydrostatic bearing means which is disposed adjacent to the porous cover. The bearing means defines a concave surface for cooperating with the porous cover. The bearing means further defines a fluid conveying passageway having a first and a second end. The first end of the passageway is connected to a source of pressurized fluid and the second end of the passageway is in fluid communication with the concave surface such that in use of the apparatus, when the porous cover of the press roll rotates, the fluid passes through the passageway and along the concave surface and between the concave surface and the porous cover. The arrangement is such that the pressurized fluid flows inwardly through the porous cover for flushing contaminants lodged within the porous cover outwardly away from the porous cover. Such outward flushing of the contaminants inhibits the buildup of the contaminants on the external surface of the porous cover that would otherwise impair the water-absorbing capabilities of the cover.

More specifically, the hydrostatic bearing means is disposed beneath the porous cover such that the porous cover cooperates with the concave surface. Also, the concave surface moves in a cross-machine direction along the entire axial length of the press roll so that the entire width of the porous cover is cleaned. Preferably, the concave surface extends around at least 1 percent of the external surface of the porous cover such that the pressurized fluid is forced to flow through the external surface and inwardly therefrom. The arrangement is such that as the hydrostatic bearing means moves along the width of the porous cover, intermittent cleaning of the cover is carried out.

Additionally, the hydrostatic bearing means also includes vacuum means disposed adjacent to the external surface of the porous cover such that contaminated fluid is drawn away from the porous cover.

In a preferred embodiment of the present invention, an air cushion is disposed below the hydrostatic bearing means for resiliently supporting the bearing means.

In one embodiment of the present invention, the pressurized fluid is water and in another embodiment the pressurized fluid is air.

In a further embodiment of the present invention, the press roll includes a solid roll core and a porous cover which extends circumferentially around and axially relative to the roll core.

In another embodiment of the present invention, the roll cover is metallic, the roll cover being isostatically pressed onto the roll core, the porous cover being fabricated by a power metallurgy technique in which the metallic powder particles have a size within the range 50–200 microns and in which these metallic powder particles are isostatically pressed against the press core. Preferably the metallic powder is of the type known as INCONEL 625.

In another embodiment of the present invention, the porous cover is flame-sprayed onto the roll core.

In a further embodiment of the present invention, the roll cover is ceramic.

In the case of a porous metallic cover, such cover is machined to define a smooth, cylindrical surface thereon for direct contact with a paper web to be pressed.

The present invention includes a method for cleaning a porous cover of a press roll of a papermaking machine, the method including the steps of:

Supporting the hydrostatic bearing on an air cushion disposed below the bearing, and Injecting pressurized fluid through the bearing inwardly through the external surface of the porous cover for flushing contaminants lodged within the porous cover outwardly away from the porous cover.

Although various specific embodiments of the present invention are described in the detailed description contained hereinafter, it should be appreciated by those skilled in the art that many variations and modifications of the present invention may be carried out without departing from the spirit and scope of the present invention as defined by the appended claims.

Included in such modifications would be the utilization of the pressure of the pressurized fluid to assist in the loading of the press nip. Also, another modification would be the provision of a metallic fiber composite cover or a reinforced plastics cover or the like.

DETAILED DESCRIPTION OF THE DRAWING

Figure 1:
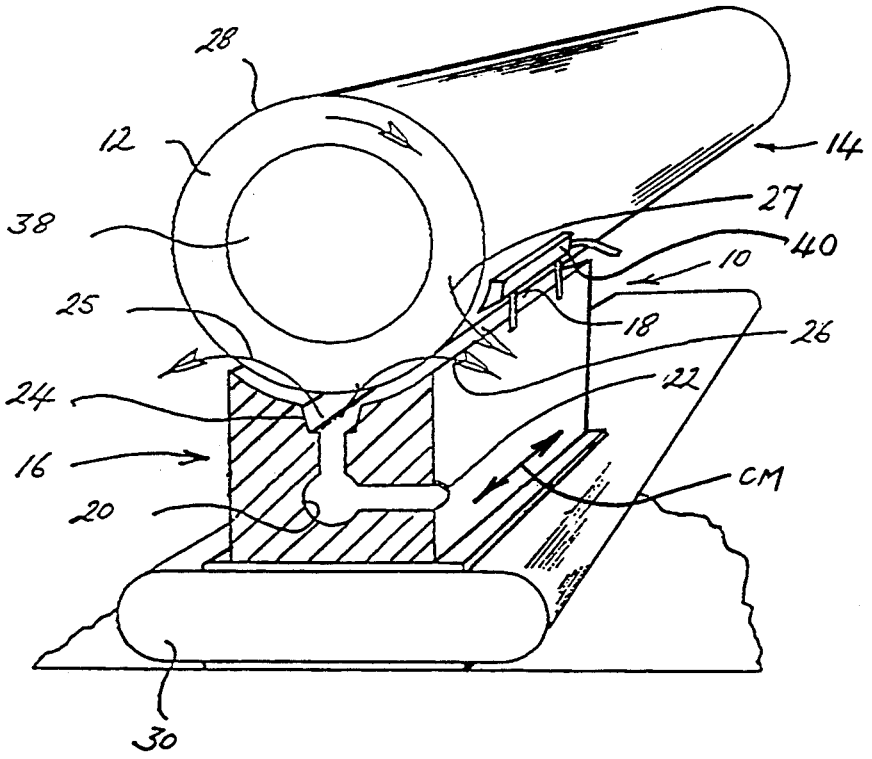
FIG. 1 is a perspective view of the apparatus according to the present invention showing a press roll including a roll core and a porous cover and in which the pressurized fluid is water.

FIG. 1 is a perspective view, partially in section, of an apparatus generally designated 10 for cleaning a porous cover 12 of a press roll generally designated 14 of a papermaking machine. The apparatus 10 includes a hydrostatic bearing means generally designated 16 which is disposed adjacent to the porous cover 12 for cooperating with the press roll 14. The bearing means 16 defines a concave surface 18 for cooperating with the porous cover 12. The bearing means 16 further defines a fluid-conveying passageway 20 having a first and a second end 22 and 24 respectively. The first end 22 of the passageway 20 is connected to a source of pressurized fluid (not shown). The second end 24 is in fluid communication with the concave surface 18 such that in use of the apparatus 10, when the porous cover 12 of the press roll 14 rotates, the fluid passes through the passageway 20 and along the concave surface 18 and between the concave surface 18 and the porous cover 12 so that the pressurized fluid as indicated by the arrows 25 and 26 flows inwardly through the porous cover 12 for flushing contaminants lodged within the porous cover 12 outwardly as shown by the arrow 27 away from the porous cover 12 thereby inhibiting the buildup of the contaminants on the external surface 28 of the porous cover 12 that would otherwise impair the water-absorbing capabilities of the cover 12.

As shown in FIG. 1, the hydrostatic bearing means 16 is disposed beneath the porous cover 12 such that the porous cover 12 cooperates with the concave surface 18.

As shown in FIG. 1, the concave surface 18 extends in a cross-machine direction as indicated by the arrow CM. Also, the bearing means 16 moves along the entire axial length of the press roll 14 as indicated also by the arrow CM.

Preferably, as shown in FIG. 1, the concave surface 18 extends around at least 1 percent of the external surface 28 of the porous cover 12 such that the pressurized fluid, as indicated by the arrows 25 and 26 is forced to flow through the external surface 28 and inwardly therefrom.

FIG. 1 also shows an air cushion 30 which is disposed below the hydrostatic bearing means 16 for resiliently supporting the bearing means 16 so that the bearing means 16 moves in a cross machine direction as indicated by the arrow CM for imparting an intermittent cleaning action to the porous cover 12.

As shown in FIG. 1, the press roll 14 includes a solid roll core 38 and a porous cover 12 which extends circumferentially around and axially relative to the roll core 38. It will be understood by those skilled in the art that the term solid roll core includes a roll shell. The roll cover 12 is metallic and is isostatically pressed onto the roll core 38. Preferably, the porous cover is fabricated by a powder metallurgy technique in which metallic powder particles having a size within the range 50–200 microns are isostatically pressed against the roll core 38.

In a preferred embodiment of the present invention, the metallic powder is flame sprayed onto the roll core 38.

Alternatively, the porous cover 12 is of the type known as INCONEL 625.

In another embodiment of the present invention, the porous cover 12 is ceramic.

In the embodiments in which the porous cover is metallic, the external surface 28 of the porous cover 12 is machined to define a smooth, cylindrical surface configuration for direct contact with a paper web to be pressed.

Vacuum means 40 is attached to the bearing means 16, so that pressurized fluid together with contaminants are removed from the external surface 28 of the porous cover 12.

In operation of the apparatus shown in FIGS. 1, pressurized fluid is injected as indicated by the arrows 25,26 such that the pressurized fluid flows inwardly through the porous cover for flushing contaminants lodged within the porous cover outwardly away from the porous cover thereby inhibiting the buildup of contaminants on the external surface 28 of the porous cover 12 which would otherwise impair the water-absorbing capabilities of the cover.

Contaminants are thereafter drawn away from the external surface of the porous cover by the vacuum means 40.

The present invention provides an apparatus for cleaning a porous cover of a press roll during use of the roll such that the external surface of the porous cover is permitted to absorb water expelled from the web at the press nip. The present invention also provides a porous cover of a press roll which exhibits an increased capability to resist crushing during passage through a press nip and which results in a pressed web having enhanced surface smoothness.

What is claimed is:

1. An apparatus for cleaning a porous cover of a press roll of a papermaking machine, said apparatus comprising:

a press roll having a porous cover;

a hydrostatic bearing means disposed adjacent to the porous cover, said bearing means defining a concave surface for cooperating with the porous cover; and said bearing means further defining a fluid conveying passageway having a first and a second end, said first end of said passageway being connected to a source of pressurized fluid, said second end being in fluid communication with said concave surface such that in use of the apparatus, when the porous cover of the press roll rotates, said fluid passes through said passageway and along said concave surface and between said concave surface and the porous cover so that said pressurized fluid flows inwardly through the porous cover for flushing contaminants lodged within the porous cover outwardly from the porous cover thereby inhibiting the buildup of said contaminants on the external surface of the porous cover that would otherwise impair the water absorbing capabilities of the cover.

2. An apparatus as set forth in claim 1 wherein the hydrostatic bearing means is disposed beneath the porous cover.

3. An apparatus as set forth in claim 1 wherein said concave surface extends around at least 1 percent of the circumference of said external surface of the porous cover such that said pressurized fluid is forced to flow through said external surface and inwardly therefrom.

4. An apparatus as set forth in claim 1 further including:

an air cushion disposed below said hydrostatic bearing means for resiliently supporting said bearing means.

5. An apparatus as set forth in claim 1 wherein said pressurized fluid is water.

6. An apparatus as set forth in claim 1 wherein said pressurized fluid is air.

7. An apparatus as set forth in claim 1 wherein the press roll includes:

a solid roll core;

a porous cover extending circumferentially around and axially relative to said roll core.

8. An apparatus as set forth in claim 7 wherein said roll cover is metallic.

9. An apparatus as set forth in claim 8 wherein said roll cover is isostatically pressed onto said roll core.

10. An apparatus as set forth in claim 8 wherein said porous cover is fabricated by a powder metallurgy technique in which metallic powder particles having a size within the range 50–200 microns are isostatically pressed against said roll core.

11. An apparatus as set forth in claim 10 wherein said metallic powder is of the type known as INCONEL 625.

12. An apparatus as set forth in claim 8 wherein said porous cover is flame-sprayed onto said roll core.

13. An apparatus as set forth in claim 7 wherein said porous cover is ceramic.

14. An apparatus as set forth in claim 8 wherein said external surface of said porous cover is machined to define a smooth, cylindrical surface thereon for direct contact with a paper web to be pressed.

15. An apparatus as set forth in claim 1 further including:

vacuum means attached to said bearing means so that pressurized fluid together with contaminants are removed from said external surface of said porous cover by said vacuum means.

16. A method for cleaning a porous cover of a press roll of a papermaking machine, said method including the steps of:

supporting a hydrostatic bearing of an air cushion disposed below the bearing; and injecting a pressurized fluid through a passageway defined by the hydrostatic bearing such that the pressurized fluid is forced through an external surface of the porous cover for flushing contaminants lodged within the porous cover outwardly away from the porous cover thereby inhibiting the buildup of contaminants on the external surface of the porous cover that would otherwise impair the water-absorbing capabilities of the cover.

* * * * *

UNITED STATES PATENT AND TRADEMARK OFFICE

CERTIFICATE OF CORRECTION

PATENT NO. : 5,092,961
DATED : March 3, 1992
INVENTOR(S) : Samuel F. Keller

It is certified that error appears in the above-indentified patent and that said Letters Patent is hereby corrected as shown below:

The title page should be deleted to appear as per attached title page.

The sheet of drawing consisting of figure 1, should be deleted to appear as per attached page.

Column 5, line 1, after "moves", insert --by means (not shown)--.

Signed and Sealed this

Eighteenth Day of January, 1994

*Attest:*

Bruce Lehman

BRUCE LEHMAN

*Attesting Officer*

*Commissioner of Patents and Trademarks*

United States Patent [19]

Keller

[11] Patent Number: 5,092,961

[45] Date of Patent: Mar. 3, 1992

[54] APPARATUS FOR CLEANING A POROUS COVER

[75] Inventor: Samuel F. Keller, Beloit, Wis.

[73] Assignee: Beloit Corporation, Beloit, Wis.

[21] Appl. No.: 204,438

[22] Filed: Jun. 9, 1988

[51] Int. Cl.[5] ..... D21F 3/00; D21F 7/00

[52] U.S. Cl. ..... 162/48; 162/274; 162/276; 162/279; 162/199; 134/138; 134/149; 134/153; 134/157

[58] Field of Search ..... 162/48, 274, 276, 279, 162/272, 275, 199; 134/153, 138, 157, 149; 15/256.51; 384/100, 12, 114, 116; 269/20, 71; 55/294

[56] References Cited

U.S. PATENT DOCUMENTS

| | | | |
|---|---|---|---|
| 3,974,026 | 8/1976 | Emson et al. | 162/358 |
| 4,234,175 | 11/1980 | Sato et al. | 269/73 |
| 4,568,423 | 2/1986 | Laapotti | 162/358 |
| 4,748,736 | 6/1988 | Miihkinen | 29/527.2 |

FOREIGN PATENT DOCUMENTS

| | | | |
|---|---|---|---|
| 477799 | 10/1951 | Canada | 162/358 |

*Primary Examiner*—David A. Simmons
*Assistant Examiner*—Thi Dang
*Attorney, Agent, or Firm*—Dirk J. Veneman; Raymond W. Campbell; David J. Archer

[57] ABSTRACT

An apparatus is disclosed for cleaning a porous cover of a press roll of a papermaking machine. The apparatus includes a hydrostatic bearing disposed adjacent to the porous cover, the bearing defining a concave surface for cooperating with porous cover. The bearing defines a fluid conveying passageway having a first and a second end. The first end of the passageway is connected to a source of pressurized fluid and the second end is in fluid communication with the concave surface such that in use of the apparatus, when the porous cover of the press roll rotates, the fluid passes through the passageway and along the concave surface and between the concave surface and the porous cover. The pressurized fluid flow inwardly through the porous cover for flushing contaminants lodged within the porous cover outwardly away from the porous cover thereby inhibiting the buildup of comtaminants on the external surface of the porous cover that would otherwise impair the water absorbing capabilities of the cover.

16 Claims, 1 Drawing Sheet

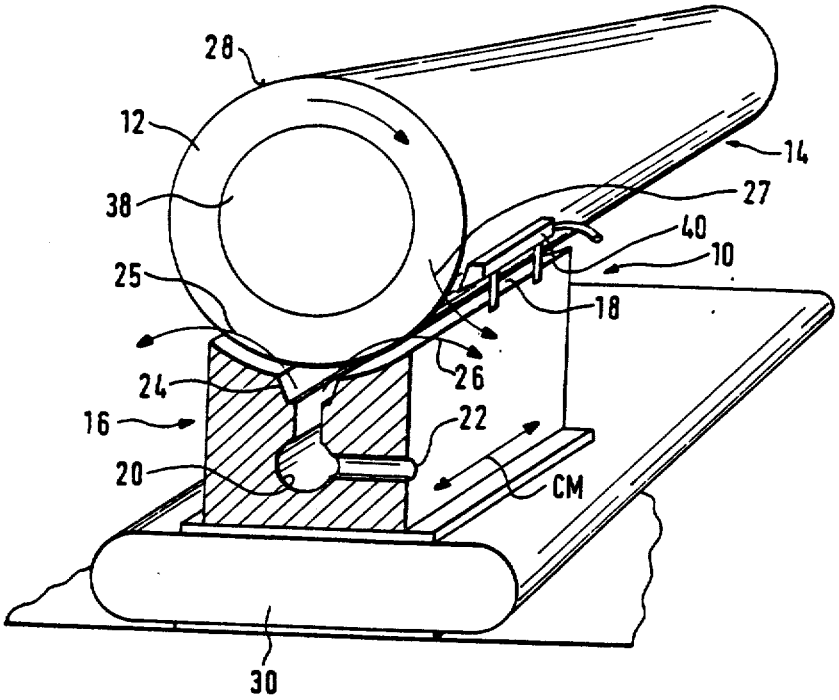

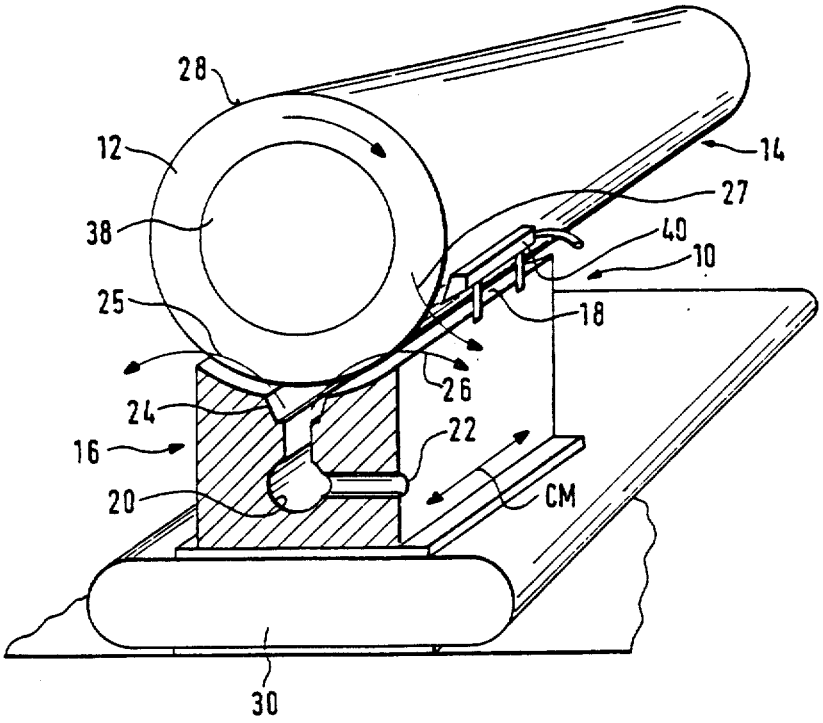
28
12
38
25
24
16
20
22
26
CM
14
27
40
10
18
30